US006837861B2

(12) United States Patent
Lin

(10) Patent No.: US 6,837,861 B2
(45) Date of Patent: Jan. 4, 2005

(54) ELECTRIC MASSAGE DEVICE FOR PRODUCING ROTATIONAL OR RECIPROCATING MASSAGE MOTION

(76) Inventor: Cheng-Hsien Lin, No. 22, Lane 511, Sec. 1, Nan Hsiung Rd., Kuan Miao Hsiang, Tainan Hsien (TW)

( * ) Notice: Subject to any disclaimer, the term of this patent is extended or adjusted under 35 U.S.C. 154(b) by 162 days.

(21) Appl. No.: 10/237,284

(22) Filed: Sep. 9, 2002

(65) Prior Publication Data

US 2004/0049136 A1 Mar. 11, 2004

(51) Int. Cl.[7] ..... A61H 7/00

(52) U.S. Cl. ..... 601/87; 601/86; 601/97; 601/101; 601/107; 601/112

(58) Field of Search ..... 601/50, 51, 85, 601/86, 87, 97, 98, 100, 101, 103, 107, 108, 111, 112

(56) References Cited

U.S. PATENT DOCUMENTS 5,183,034 A * 2/1993 Yamasaki et al. ..... 601/70
5,464,382 A * 11/1995 Wang ..... 601/108
5,797,859 A * 8/1998 Prehodka ..... 601/113
6,494,849 B2 * 12/2002 Kuo ..... 601/112
6,551,259 B1 * 4/2003 Wu ..... 601/103
6,656,140 B2 * 12/2003 Oguma et al. ..... 601/103

* cited by examiner

*Primary Examiner*—Nicholas D. Lucchesi
*Assistant Examiner*—Quang D. Thanh
(74) *Attorney, Agent, or Firm*—Charles E. Baxley

(57) ABSTRACT

An electric massage device comprises a motor, a base, at least one gear train including a driven gear rotatably supported in the base, at least one movable member, and at least one massage member. The driven gear is driven by an output shaft of the motor. The driven gear includes engaging grooves in a side thereof. The movable member includes a toothed portion having a plurality of teeth. The massage member is securely connected to the movable member to move therewith. The engaging grooves of the driven gear and the teeth of the movable member are so configured that when the output shaft turns in a direction, the movable member and the massage member are turned, and that when the output shaft turns in a reverse direction, the movable member and the massage member move reciprocatingly.

5 Claims, 9 Drawing Sheets

ELECTRIC MASSAGE DEVICE FOR PRODUCING ROTATIONAL OR RECIPROCATING MASSAGE MOTION

BACKGROUND OF THE INVENTION

1. Field of the Invention

The present invention relates to an electric massage device. In particular, the present invention relates to an electric massage device including massage members that can perform rotational movement or reciprocating movement according to need, thereby reducing the cost and volume of the electric massage device.

2. Description of the Related Art

It is common to incorporate an electric device into furniture such as a chair, bed, or the like. Thus, the user may feel quite restored through massage. The massage members of a massage device may perform only one type of movement; namely rotational movement or reciprocating movement. The massage members that rotate may provide a rotational massage effect, and the massage members that move reciprocatingly along a rectilinear path may provide an impinging massage effect. Two different sets of control devices are required for enabling rotational movement and reciprocating movement of the massage members. The overall cost and volume for the massage device are both increased.

SUMMARY OF THE INVENTION

An object of the present invention is to provide an electric massage device including massage members that can perform rotational movement or reciprocating movement according to need, thereby reducing the cost and volume of the electric massage device.

An electric massage device in accordance with the present invention comprises:

a motor including an output shaft;

a base including at least one through-hole;

at least one gear train including a driven gear rotatably supported in said base, said driven gear being driven by said output shaft of said motor, said driven gear including a plurality of engaging grooves in a side thereof, a periphery defining each said engaging groove including a first pressing face and a first slide/guide face;

at least one movable member mounted in said base and having an end extending through said through-hole of said base, said at least one movable member including a toothed portion on another end thereof, said toothed portion having a plurality of teeth, each said tooth including a second pressing face and a second slide/guide face;

at least one massage member located outside said base, said at least one massage member being securely connected to said at least one movable member to move therewith; and at least one elastic element attached between said base and said at least one movable member for urging said teeth of said at least one movable member to engage with said engaging grooves of said driven gear;

wherein when said output shaft of said motor turns in a direction, said first pressing face of each said engaging groove of said driven gear presses against an associated one of said second pressing faces of said at least one movable member, thereby causing said at least one movable member and said at least one massage member to turn; and wherein when said output shaft of said motor turns in a reverse direction, said first slide/guide face of each said engaging groove of said driven gear slides along an associated one of said second slide/guide faces of said at least one movable member, thereby causing said at least one movable member and said at least one massage member to move reciprocatingly along a rectilinear path.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
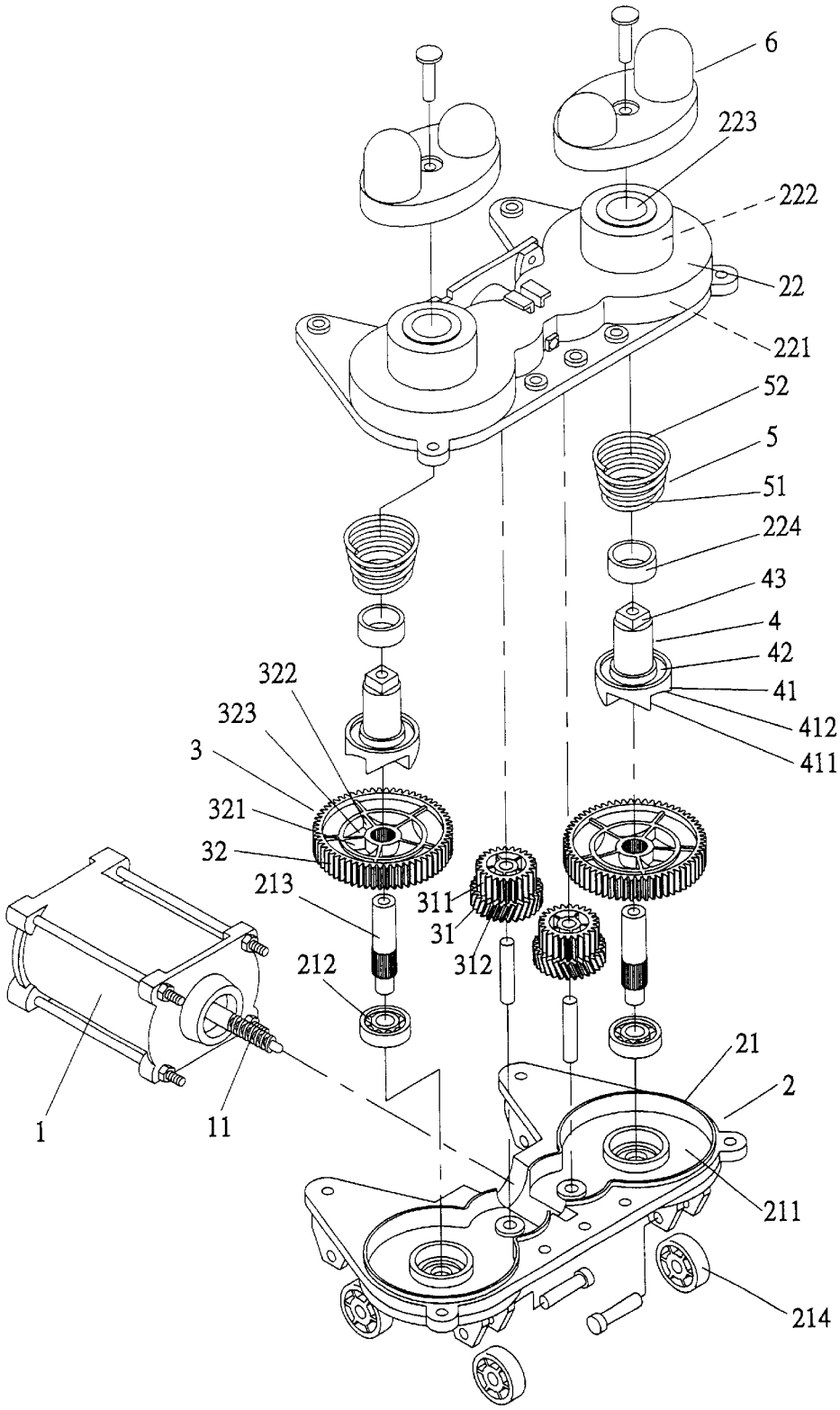
FIG. 1 is an exploded perspective view of an electric massage device in accordance with the present invention.
Figure 2:
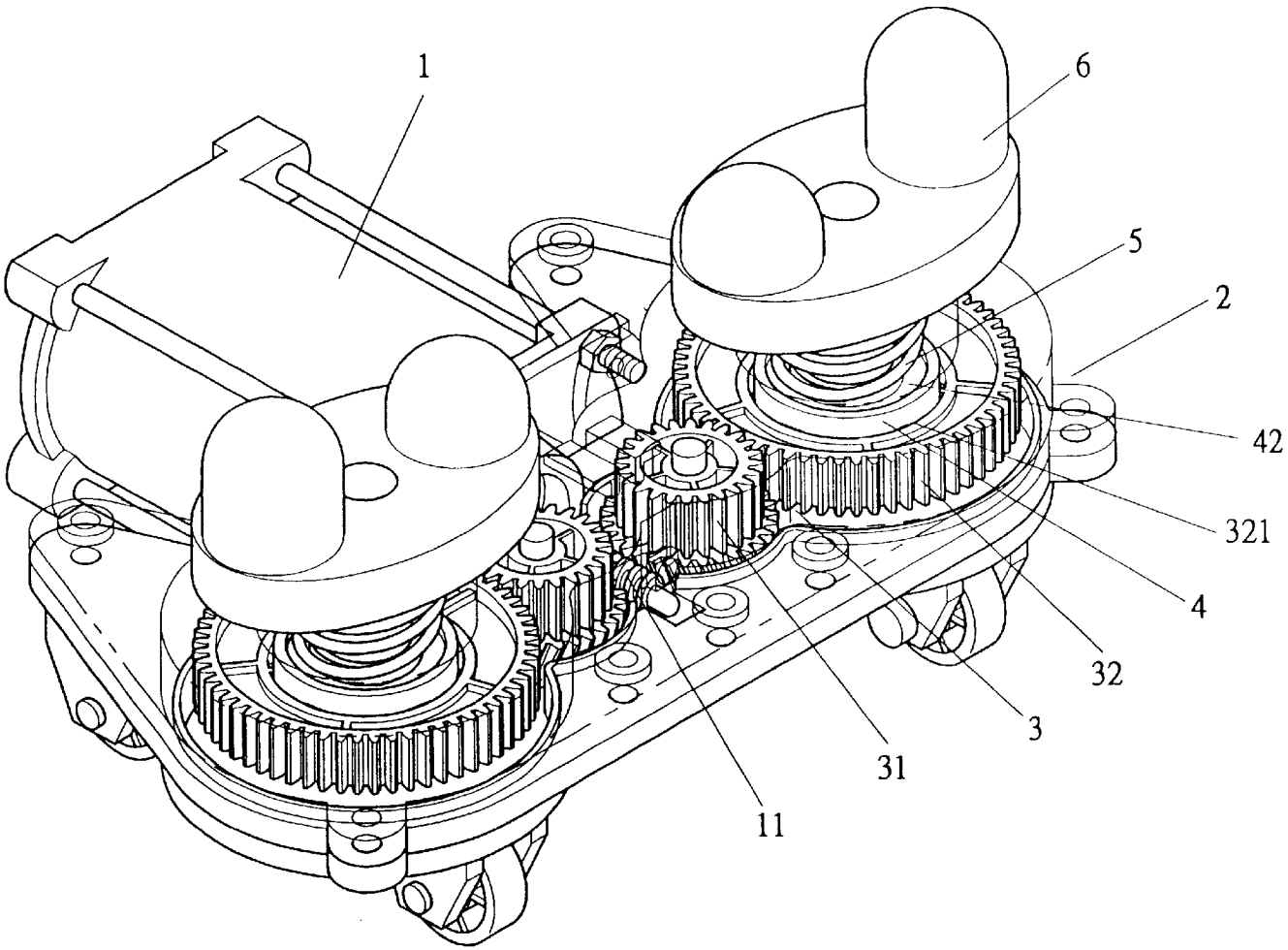
FIG. 2 is a perspective view of the electric massage device in accordance with the present invention.
Figure 3:
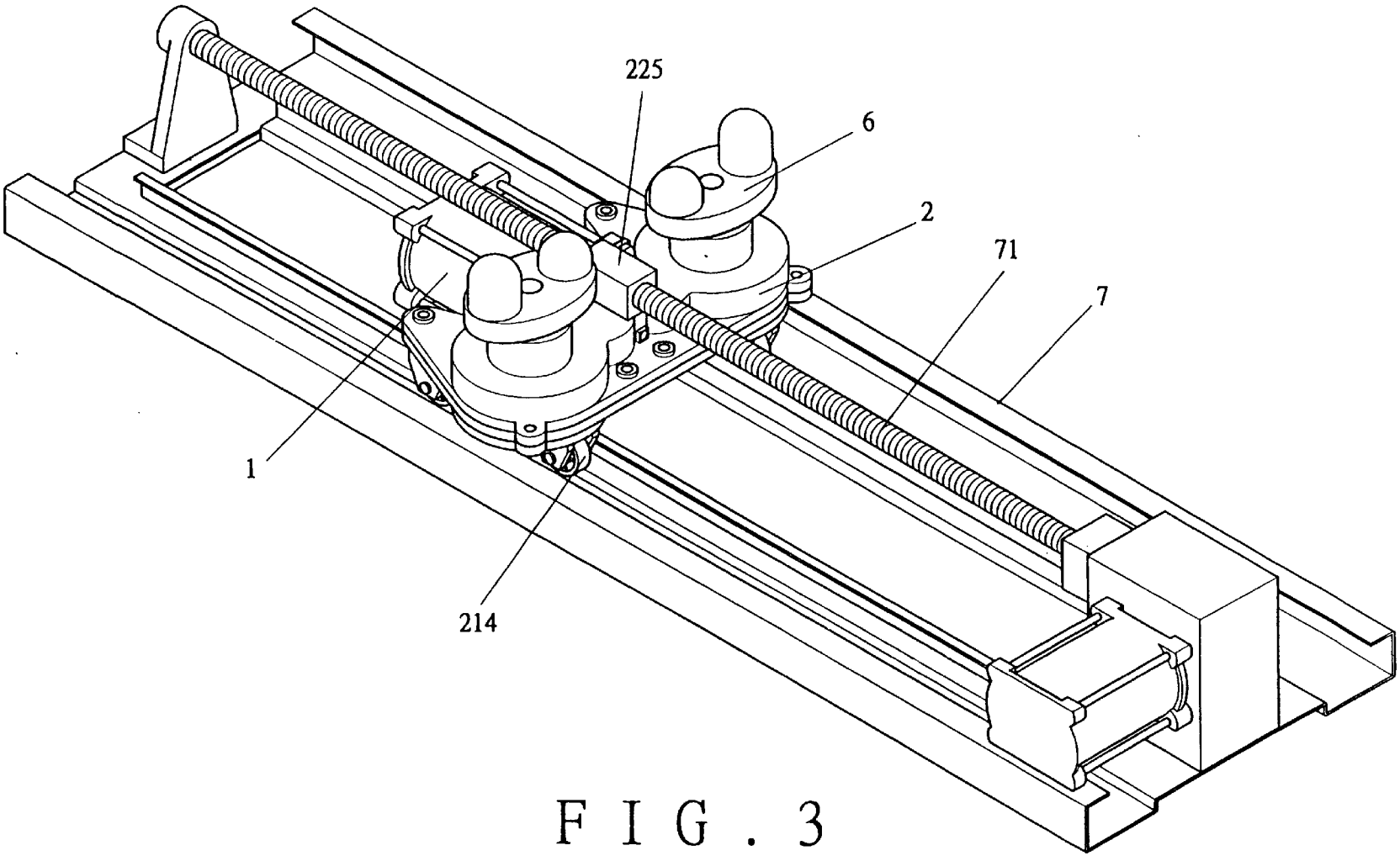
FIG. 3 is a perspective view of a fixed frame on which the electric massage device may be mounted.
Figure 4:
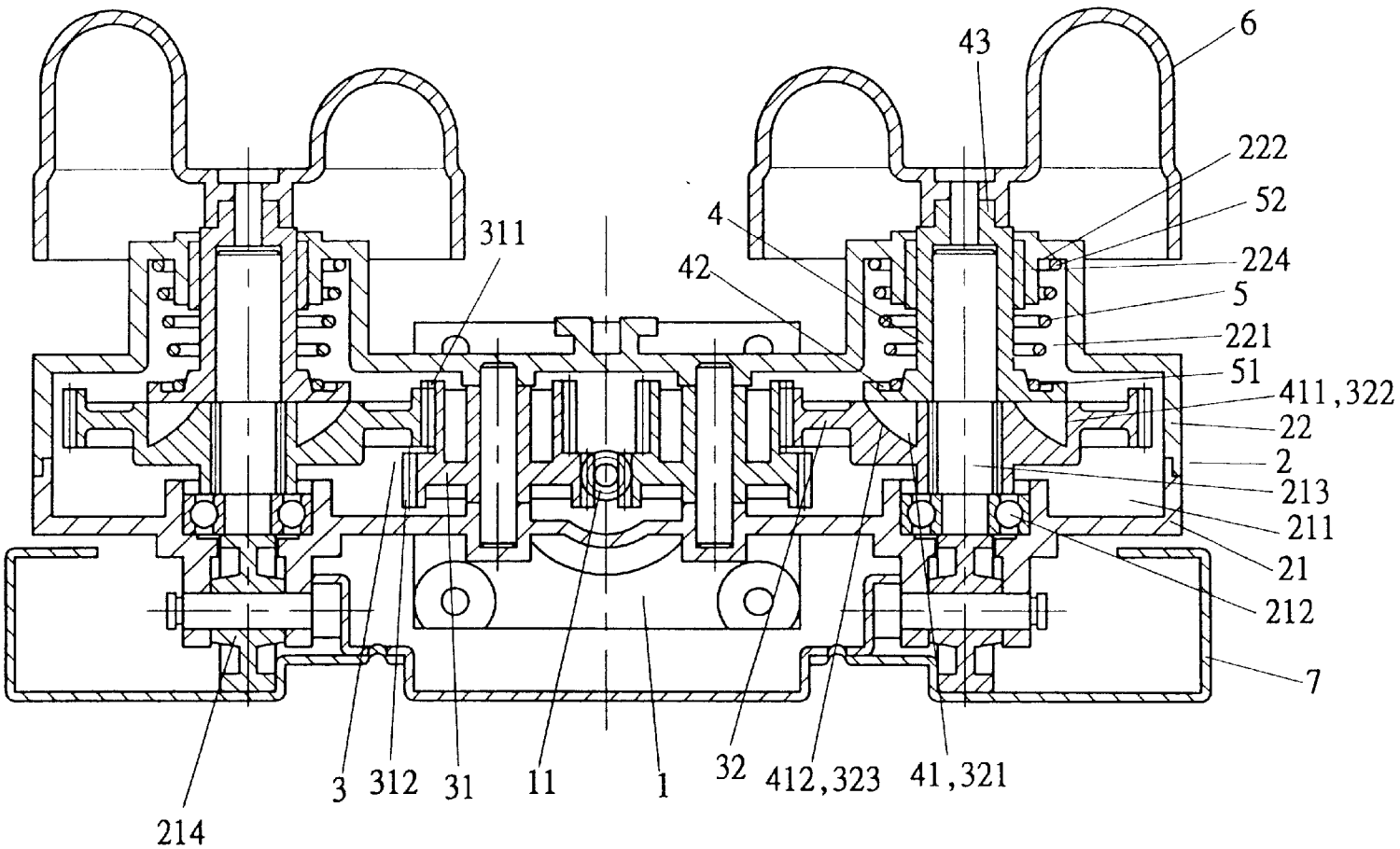
FIG. 4 is a sectional view of the electric massage device in accordance with the present invention.

Referring to FIGS. 1 through 4, an electric massage device in accordance with the present invention generally comprises a motor 1, a base 2, at least one gear train 3, at least one movable member 4, at least one elastic element 5, and at least one massage member 6. The motor 1 includes an output shaft 11 that is meshed with the gear trains 3. There are two gear trains 3, two movable members 4, two elastic elements 5, and two massage members 6 in this embodiment.

The base 2 includes a lower base member 21 and an upper base member 22. The lower base member 21 and the upper base member 22 include compartments 211 and 221 for accommodating the gear trains 3. Two shafts 213 are rotatably mounted in the base 2 and supported by bearings 212. The upper base member 22 includes two receiving sections 222 each for receiving an end 51 of an associated elastic element 5. Each receiving section 222 of the upper base member 22 includes a through-hole 223 through which an associated movable member 4 extends. An abrasion-resistant member 224 is mounted to an inner periphery defining the through-hole 223. A plurality of wheels 214 may be attached to an underside of the lower base member 21. An engaging block 225 (FIG. 3) having a screw hole (not shown) may be provided on the upper base member 22 for threading engagement with a screw rod 71 on a fixed frame 7. Thus, the wheels 214 may move on the fixed frame 7 and thus change the position of the electric massage device through transmission by the engaging block 225 and the screw rod 71.

Each gear train 3 includes a drive gear 31 and a driven gear 32. The drive gear 31 is a dual gear consisting of an upper gear 311 meshed with the driven gear 32 and a lower gear 312 meshed with the output shaft 11 of the motor 1. The driven gear 32 is securely mounted to an associated shaft 213 to turn therewith. The driven gear 32 further includes a plurality of engaging grooves 321 in a side thereof for engaging with a complimentarily formed toothed portion 41 of an associated movable member 4. A periphery defining each engaging groove 321 includes a pressing face 322 and a slide/guide face 323. The speed of the motor is reduced after transmission by the gear train 3.

Each movable member 4 is mounted on an associated shaft 213 and located on top of an associated driven gear 32. Each movable member 4 includes an toothed portion 41 on a bottom thereof, the toothed portion 41 having a plurality of teeth for engaging with the engaging grooves 321 of the associated driven gear 32. Each tooth of the toothed portion 41 includes a pressing face 411 and a slide/guide face 412. Each movable member 4 further includes a receiving section 42 for receiving the other end 51 of the associated elastic element 5. Further, an upper end of each movable member 4 extends through an associated through-hole 223 and is securely engaged with an associated massage member 6 to move therewith. The massage members 6 are located above the upper base member 22.

Each elastic element 5 includes two ends 51 and 52 that are respectively attached to the receiving section 42 of the associated movable member 4 and the associated receiving section 222 of the upper base member 22, thereby biasing the associated movable member 4 downward to urge the toothed portion 41 of the associated movable member 4 into the engaging grooves 321 of the associated driven gear 32.

Figure 5:
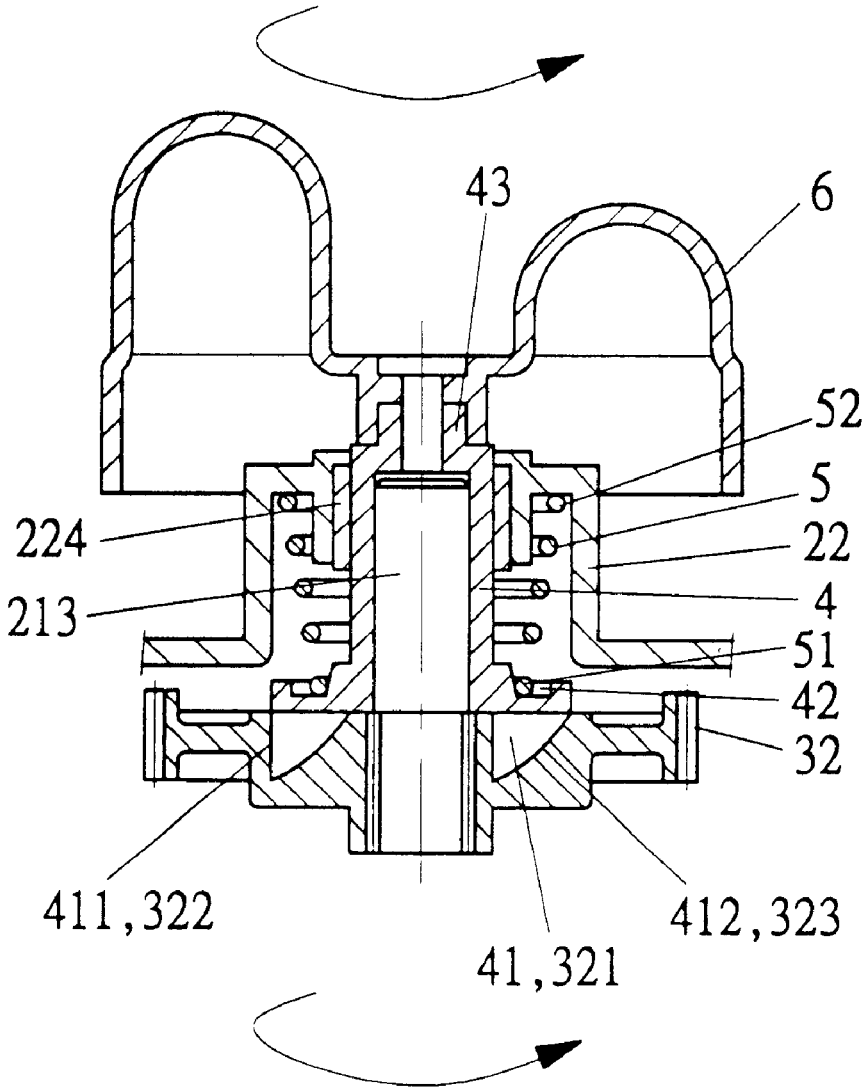
FIG. 5 is a sectional view illustrating rotational movement of a massage member of the electric massage device.
Figure 6:
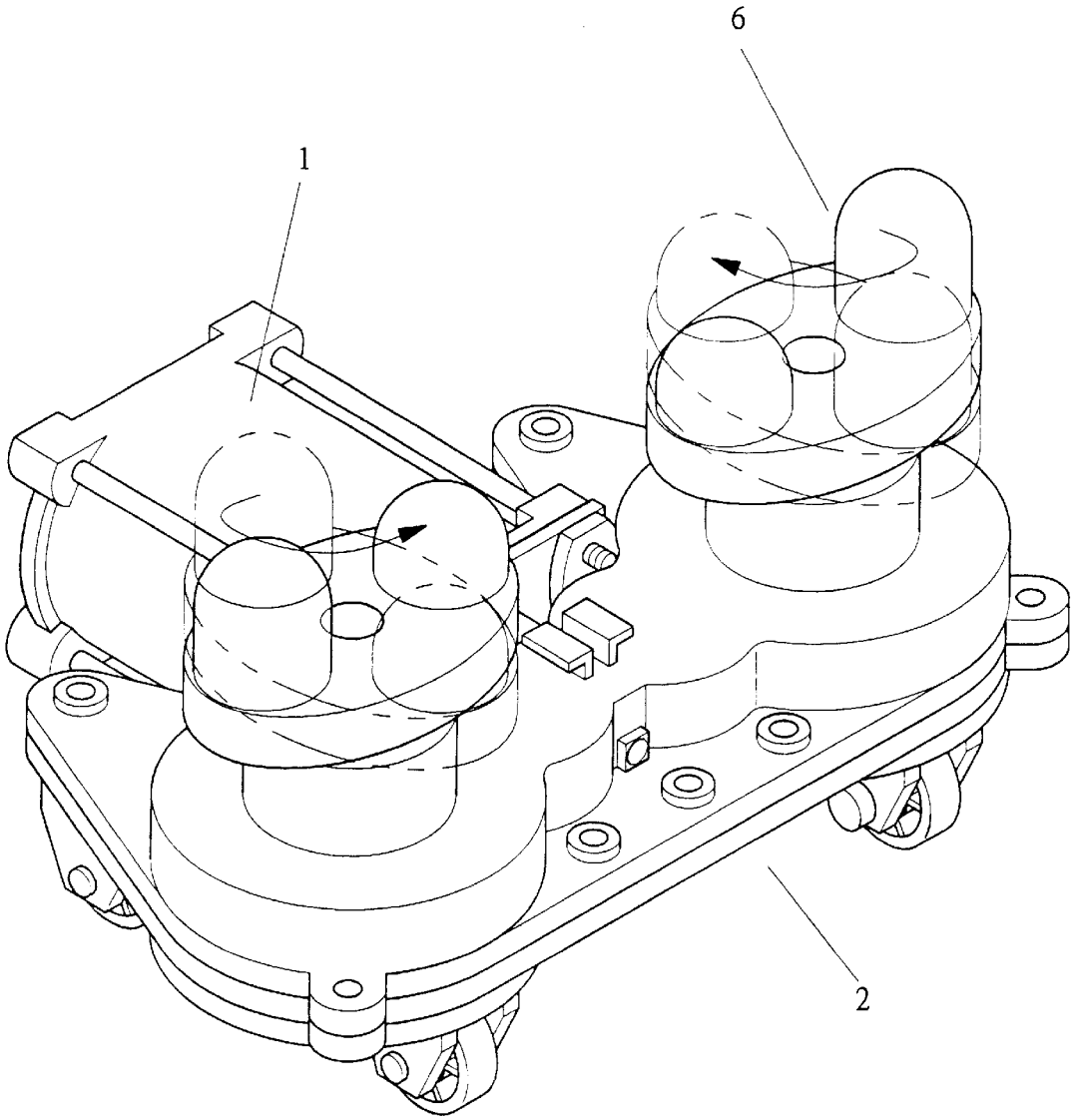
FIG. 6 is a perspective view of the electric massage device, illustrating rotational movement of the massage members.

Referring to FIGS. 5 and 6, when the motor 1 turns in a direction, e.g., clockwise, the drive gear 31 and the driven gear 32 of each gear train 3 are turned. The driven gear 32 turns in a direction that allows the pressing face 322 of the driven gear 32 to press against the pressing face 411 of the toothed portion 41 of the associated movable member 4. Thus, the associated movable member 4 and the associated massage member 6 are turned accordingly to provide a rotational massage effect. The abrasion-resistant member 224 reduces wear resulting from rotation and thus provides smooth rotation.

Figure 7:
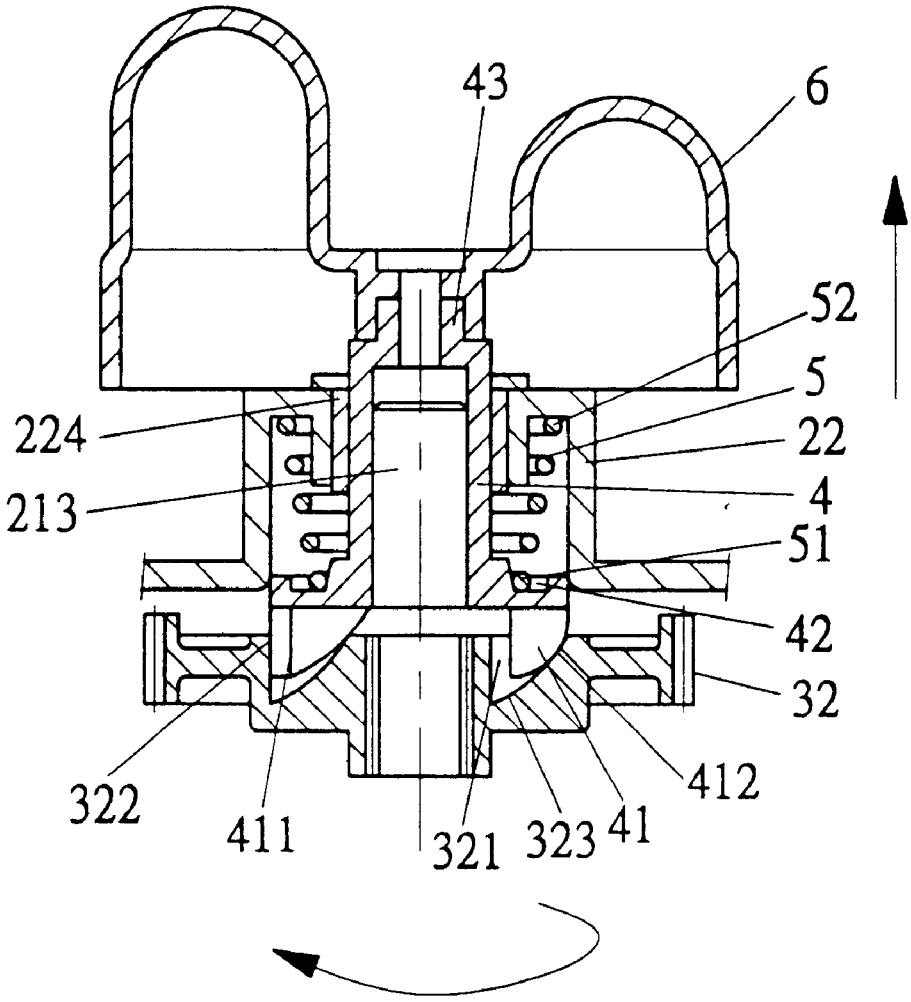
FIGS. 7 and 8 are sectional views illustrating reciprocating movement of a massage member of the electric massage device.
Figure 8:
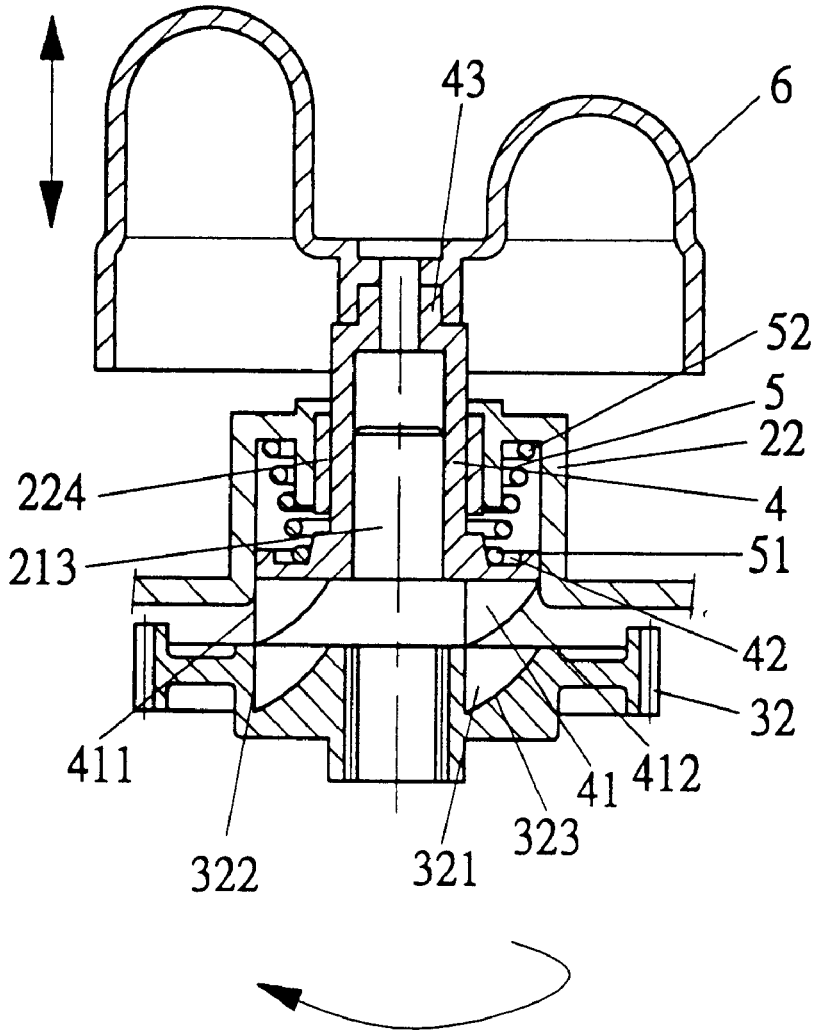
Figure 9:
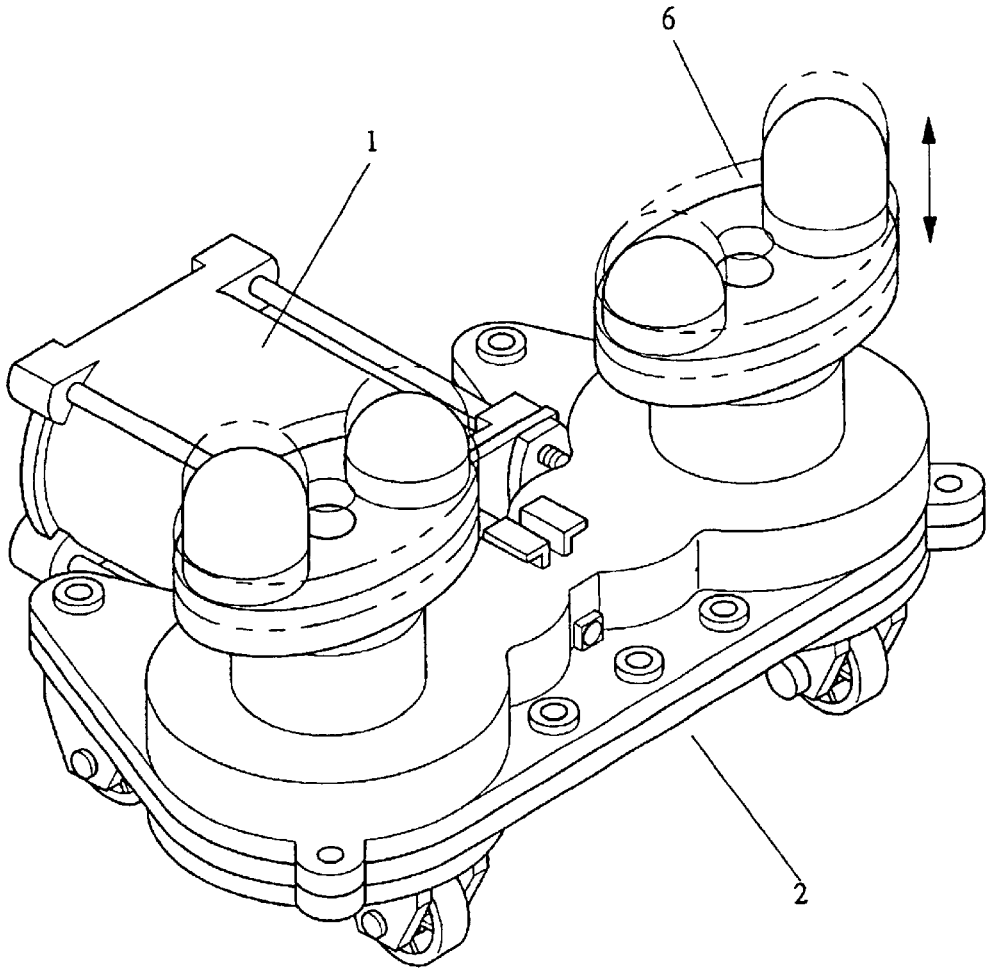
FIG. 9 is a perspective view of the electric massage device, illustrating reciprocating movement of the massage members.

Referring to FIGS. 7 through 9, when the motor 1 turns in a reverse direction, e.g., counterclockwise, the drive gear 31 and the driven gear 32 of each gear train 3 are turned. The driven gear 32 turns in a reverse direction that allows the slide/guide face 323 of the driven gear 32 to slide along the slide/guide face 412 of the toothed portion 41 of the associated movable member 4. Thus, the associated movable member 4 and the associated massage member 6 are not turned. Instead, the associated movable member 4 and the associated massage member 6 move reciprocatingly along a vertical direction, thereby providing an intermittent impinging massage effect.

The reciprocating movement of the massage member 6 depends on the number of the teeth of the toothed portion 41 of the associated movable member 4. Namely, the reciprocating speed of the massage member 6 is increased if the number of the teeth of the associated movable member 4 and the number of the engaging grooves 321 of the associated driven gear 32 are increased. The electric massage device in accordance with the present invention may be used on a fixed frame 7, allowing movement of the electric massage device. However, the electric massage device can be fixed in place during use. The electric massage device provides rotational movement and reciprocating movement for the massage members by means of providing a single motor and corresponding arrangement. The number of parts of the electric massage device is relatively small and the electric massage device occupies a relatively small space.

Although the invention has been explained in relation to its preferred embodiment, it is to be understood that many other possible modifications and variations can be made without departing from the scope of the invention as hereinafter claimed.

What is claimed is:

1. An electric massage device comprising:

a motor including an output shaft;

a base including at least one through-hole;

at least one gear train including a driven gear rotatably supported in said base, said driven gear being driven by said output shaft of said motor, said driven gear including a plurality of engaging grooves in a side thereof, a periphery defining each said engaging groove including a first pressing face and a first slide/guide face;

at least one movable member mounted in said base and including a toothed portion on another end thereof, said toothed portion having a plurality of teeth, each said tooth including a second pressing face and a second slide/guide face;

at least one massage member located outside said base, said at least one massage member being securely connected to said at least one movable member to move therewith; and at least one elastic element attached between said base and said at least one movable member for urging said teeth of said at least one movable member to engage with said engaging grooves of said driven gear;

wherein when said output shaft of said motor turns in a direction, said first pressing face of each said engaging groove of said driven gear presses against an associated one of said second pressing faces of said at least one movable member, thereby causing said at least one movable member and said at least one massage member to turn; and wherein when said output shaft of said motor turns in a reverse direction, said first slide/guide face of each said engaging groove of said driven gear slides along an associated one of said second slide/guide faces of said at least one movable member, thereby causing said at least one movable member and said at least one massage member to move reciprocatingly along a rectilinear path.

2. The electric massage device as claimed in claim 1, further including an abrasion-resistant member mounted in said at least one through-hole of said base.

3. The electric massage device as claimed in claim 1, wherein said base includes an upper base member and a lower base member having compartments for accommodating said at least one gear train.

4. The electric massage device as claimed in claim 3, wherein said at least one gear train further includes a drive gear providing transmission between said output shaft of said motor and said driven gear for reducing speed.

5. The electric massage device as claimed in claim 1, wherein said base includes a receiving section to which an end of said at least one elastic element is attached, and wherein said at least one movable member includes a receiving section to which another end of said at least one elastic element is attached.

* * * * *